United States Patent [19]

Decker

[11] 4,268,181

[45] May 19, 1981

[54] INK AND ERROR CORRECTION RIBBON ASSEMBLY

[75] Inventor: Herbert Decker, Lauf, Fed. Rep. of Germany

[73] Assignee: Triumph-Werke Nurnberg A.G., Nuremberg, Fed. Rep. of Germany

[21] Appl. No.: 122,651

[22] Filed: Feb. 19, 1980

[30] Foreign Application Priority Data

Sep. 3, 1979 [DE] Fed. Rep. of Germany ..... 2909231

[51] Int. Cl.[3] ..... B41J 35/28

[52] U.S. Cl. ..... 400/208; 400/214; 400/697.1

[58] Field of Search ..... 400/208, 214, 695, 697.1

[56] References Cited

U.S. PATENT DOCUMENTS

| | | | |
|---|---|---|---|
| 3,397,767 | 8/1968 | Hobbs | 400/697.1 |
| 3,904,017 | 9/1975 | Frechette | 400/214 X |
| 3,964,595 | 6/1976 | Edstrom | 400/208 X |

FOREIGN PATENT DOCUMENTS 2820266 11/1978 Fed. Rep. of Germany .

OTHER PUBLICATIONS

*IBM Technical Disclosure Bulletin,* vol. 22, No. 6, Nov. 1979, Schaefer, "Two-Color Cartridge Ribbon System with Correction," pp. 2327–2329.

*Primary Examiner*—Edgar S. Burr
*Assistant Examiner*—C. A. Pearson

[57] ABSTRACT

An inked and error correction ribbon assembly comprising an inked ribbon cassette adapted to be pivotally mounted in a machine and an error correction ribbon holder having support arms which embrace the inked ribbon cassette and pivotally support the error correction ribbon holder about the pivot of the inked ribbon cassette. The ribbon cassette and the inked ribbon holder each have forwardly extending spaced ribbon guides, with the guides of the error ribbon holder located outwardly of the guides of the inked ribbon cartridge to provide areas in which error correction ribbon spools can be located forwardly of the inked ribbon cassette and between the inked ribbon and error correction ribbon guides. The assembly allows the location of both the error correction and ink ribbon spools in substantially the same horizontal plane and allows movement of the inked ribbon cassette independently of the error ribbon holder.

4 Claims, 2 Drawing Figures

FIG-2
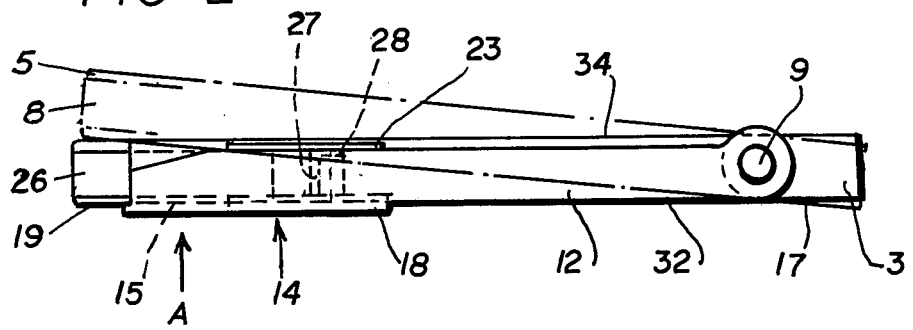
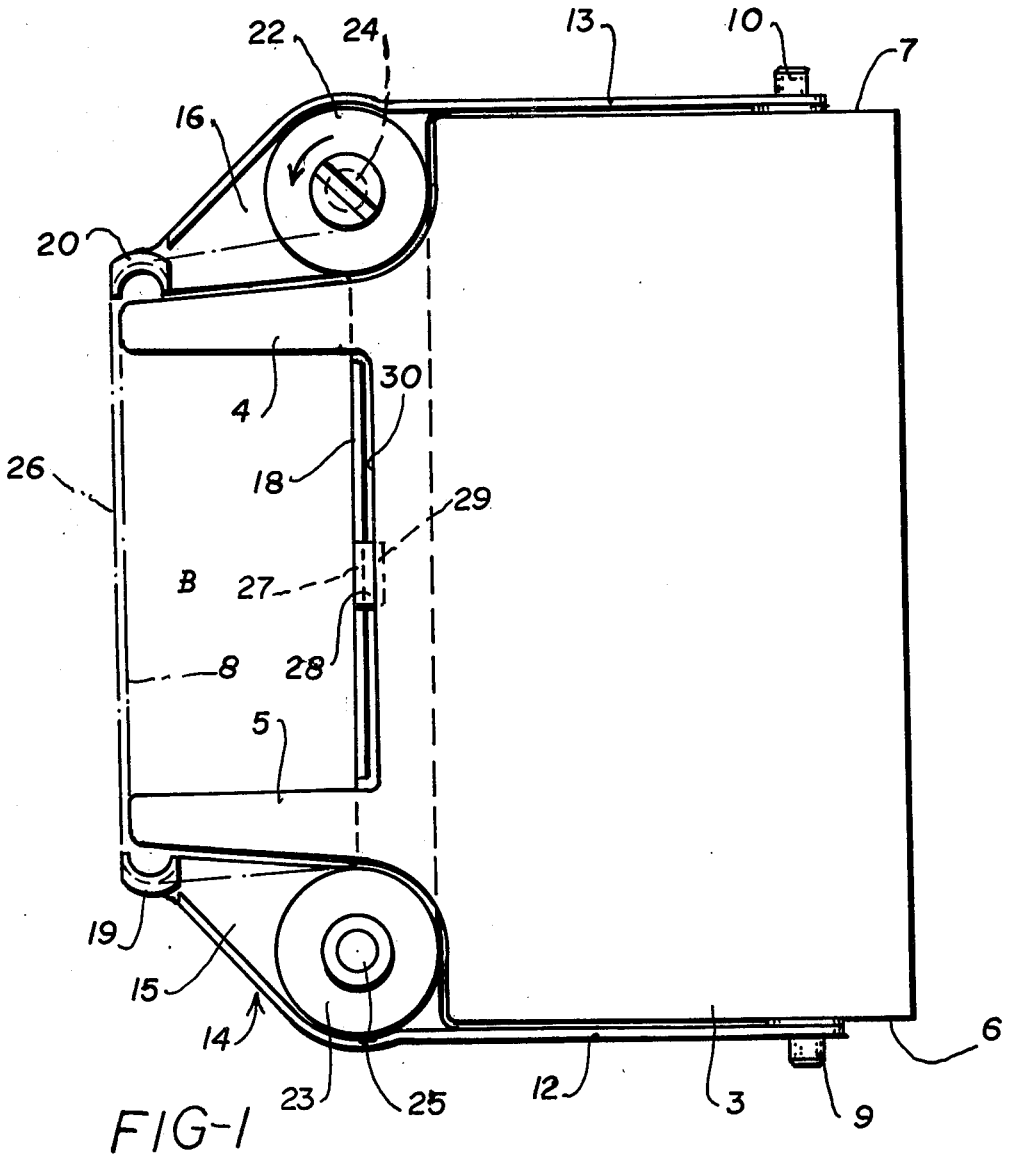
FIG-1

INK AND ERROR CORRECTION RIBBON ASSEMBLY

This invention relates to ink and error ribbon assemblies mountable in a machine; more particularly, it relates to an ink and error correction ribbon assembly having an ink ribbon cassette independently movable about an axis and an error correction ribbon holder located generally coplanar with the ink ribbon cassette and supported for movement about the axis of the ink ribbon cassette; and specifically to such an ink and error correction assembly having interconnection means between the ink ribbon cassette and the error correction ribbon holder serving to maintain them substantially coplanar yet allow independent movement of the inked ribbon cassette.

Ink and error ribbon unit assemblies are known, for example, in German OS No. 28 20 266 claiming priority of U.S. Application Ser. No. 801,286 filed May 27, 1977. This arrangement, however, has a considerable height; the entire device must be swivelled very far upward in a correction to bring the correction ribbon into printing position; and relatively great masses must be moved in a regular typing operation to bring the ink ribbon into printing position.

In accordance with the invention, an inked ribbon and error correction ribbon assembly is provided free of the noted shortcomings, in the provision of an error correction ribbon holder and guide, which is pivotally mounted externally of and coplanar with the inked ribbon cassette about the pivot axis of the inked ribbon cassette. The common pivot axis results in particularly favorable movements. Both devices are provided with forwardly extending spaced guides for the respective ribbons, to provide sufficient room to embrace a type body such as for example a ball, cylinder, type disk or other type body.

A feature of the invention resides in the fact that the overall height is low, and that the masses which have to be moved to bring one of the ribbons or both into printing position are minimized.

An object of the invention is in the provision of an inked and error correction ribbon assembly having a height substantially that of the width of the inked ribbon.

Another object of the invention is to provide an inked and error correction ribbon assembly in which the error correction ribbon structure is mounted externally of, coplanar with, and on the pivot axis of the inked ribbon cassette.

Another object of the invention is in the provision of an inked and error correction assembly in which only the mass of the inked ribbon structure need be moved during printing.

Other objects and many of the attendant advantages of this invention will be readily appreciated as the same becomes better understood by reference to the following detailed description when considered in connection with the accompanying drawing in which like reference numerals designate like or corresponding parts throughout the figures thereof and wherein In the drawing FIG. 1 is a top view of the assembly in accordance with the invention; and FIG. 2 is a side elevation of the assembly.

Referring now to the drawing, there is shown in FIG. 1 a cassette 3 having forwardly extending inked ribbon guide arms 4 and 5 located inwardly of the side walls 6 and 7 of the cassette 3 and spaced apart to accommodate between them a type body. Ribbon spools (not shown) rotatably supported in the cassette 3 carry an inked ribbon 8 which extends from one spool through guide arm 4 across the gap between guide arms 4 and 5 and through guide arm 5 to the other spool. The inked ribbon cassette 3 is adapted to be pivoted bodily about pivot pins 9 and 10 extending from the opposite side walls 6 and 7 of the cassette 3 to present the inked ribbon 8 opposite a printing line as shown by dotted lines in FIG. 2 incident to each printing operation as is necessary in order to permit the operator to see the printed text in the rest position of ink ribbon 8. The lifting device (not shown) for cassette 3 is indicated by arrow A. Also not shown is the inked ribbon spool feeding mechanism, since it depends on the respective machine.

As it can be seen from FIGS. 1 and 2, support arms 12 and 13 of a correction ribbon holder generally designated by reference numeral 14 are pivotally mounted on pivot pins 9 and 10. The correction ribbon holder 14 can be made of plastic, for example, which is sufficiently flexible to allow support arms 12 and 13 to be spread to such an extent that they can be mounted on pivot pins 9 and 10 extending from the opposite side walls 6 and 7 of the cassette 3.

As shown in FIG. 1, the support arms 12 and 13 of the correction ribbon holder 14 extend forwardly from the pivot pins 9 and 10 beyond the cassette 3 and are curved toward the ends of the inked ribbon guide arms 4 and 5 of the ribbon cassette 3. Each of the support arms 12 and 13 generally forwardly of the cassette 3 are integrally formed with error correction ribbon spool support platforms 15 and 16 generally in the plane of the bottom wall 17 and forward of the cassette 3 and located between the support arms 12 and 13 and inked ribbon guide arms 4 and 5. The platforms 15 and 16 are connected by a cross web 18 thereby forming a unitary holder 14.

Extending upwardly from the forward ends of the platforms 15 and 16 and canted toward one another are curved error correction ribbon guides 19 and 20. Error correction ribbon spools 22 and 23 are rotatably supported on posts 24 and 25 extending upwardly from the platforms 15 and 16. As shown in FIG. 1, a correction ribbon 26 extends from the supply spool 23 around the ribbon guide 19 via a gap between the guide 19 and the forward end of the support arm 12, across a gap between guides 19 and 20 and around ribbon guide 20 and to the take-up spool 22. As shown, the correction ribbon 26 is so guided over guides 19 and 20 that it is located forwardly of the inked ribbon 8 between the platen (not shown) and the ink ribbon 8 when the assembly is inserted into a machine. Guides 4, 5, 19 and 20 are so designed that space B is provided in which the type body (not shown) can move for adjustment.

The cross web 18 of correction ribbon holder 14 is also formed with an upwardly extending finger 27. The upper end 28 of the finger 27 is bent off and extends into a slot 29 in the forward wall 30 of cassette 3. Slot 29 is so designed that the cassette 3 can be rasised independently of correction ribbon holder 14. It also serves to limit the downward pivotal movement of the correction ribbon holder 14 relative to the cassette 3 when the assembly is out of a machine.

The entire assembly can be removed and replaced as a unit or, removed as a unit, and the cassette 3 separated from the correction ribbon holder 14 when one of the ribbons 8 or 26 is used up, while the other still contains unused ribbon. It is very simple for an operator to attach correction ribbon holder 14 with arms 12 and 13 on pivot pins 9 and 10 and then insert the entire assembly into a machine.

In regular typing, only cassette 3 which, because of slot 29, can move relative to holder 14, is turned about pivot pins 9 and 10 in the direction of arrow A, so that guide arms 4 and 5 bring ink ribbon 8 into printing position, as indicated in FIG. 2 in broken lines. In a correction operation, the error correction holder 14 is elevated in the direction of arrow A and via finger 27 acting on the upper edge of slot 29 carries also the cassette 3. Thus, both the correction ribbon 26 and inked ribbon 8 are elevated into printing position by means of their respective guides 19 and 20 and 4 and 5. In typing out a character, the type body strikes through both ink ribbon 8 and the correction ribbon 26, which is adjacent a platen so that the correction is made.

As it can be readily appreciated, the disclosed arrangement results in a very flat device. It can still be kept relatively flat in machines wherein the ink ribbon, as known, is incrementally elevated to allow typing in superposed tracks. The total thickness of the assembly is merely thicker by the cassette top and bottom walls 34 and 32 than the width of the ink ribbon 8. It can also be seen that correction ribbon holder 14 remains in rest position during normal typing, and thus the masses to be normally moved during typing are small.

The invention claimed is:

1. In combination, an inked ribbon casette having spaced guide arms extending therefrom and supporting an inked ribbon for movement across said spaced arms, means supporting said cassette for bodily movement about a horizontal axis, and a correction ribbon holder having spaced guides and supporting an error correction ribbon for movement across said spaced guides outwardly of said inked ribbon arms, said correction ribbon holder including support arms embracing and pivotally supported about said horizontal axis whereby said ink ribbon cassette can be pivoted independently of said correction ribbon holder.

2. The combination recited in claim 1, said correction ribbon holder including means for carrying said inked ribbon cassette when said correction ribbon holder is pivoted about said horizontal axis.

3. The combination recited in claim 1 or 2, said ink ribbon cassette guide arms being located inwardly of and generally parallel to the cassette end walls, and said correction ribbon holder support arms being parallel with said side walls whereby error correction supply and take up spools may be accommodated between said spaced guide arms and said spaced support arms.

4. The combintion recited in claim 1 or 2, said error correction ribbon holder guide arms being flexible whereby they can be removably mounted on said inked ribbon cassette.

* * * * *